US011079103B2

(12) United States Patent
Huprich

(10) Patent No.: US 11,079,103 B2
(45) Date of Patent: Aug. 3, 2021

(54) WHEELCHAIR LIGHTING CONTROL UNIT

(71) Applicant: Michael Huprich, Scheinfeld (DE)

(72) Inventor: Michael Huprich, Scheinfeld (DE)

( * ) Notice: Subject to any disclaimer, the term of this patent is extended or adjusted under 35 U.S.C. 154(b) by 0 days.

(21) Appl. No.: 16/582,951

(22) Filed: Sep. 25, 2019

(65) Prior Publication Data

US 2020/0096190 A1 Mar. 26, 2020

(30) Foreign Application Priority Data

Sep. 26, 2018 (DE) ..... 20 2018 004 480.6
May 14, 2019 (DE) ..... 20 2019 002 101.9

(51) Int. Cl.

| | |
|---|---|
| ***F21V 33/00*** | (2006.01) |
| ***F21S 9/02*** | (2006.01) |
| ***F21V 23/00*** | (2015.01) |
| ***F21V 23/06*** | (2006.01) |
| ***A61G 5/10*** | (2006.01) |
| ***F21V 23/02*** | (2006.01) |
| ***H05B 45/00*** | (2020.01) |
| ***F21Y 115/10*** | (2016.01) |

(52) U.S. Cl.

CPC ..... *F21V 33/0068* (2013.01); *A61G 5/10* (2013.01); *F21S 9/02* (2013.01); *F21V 23/007* (2013.01); *F21V 23/023* (2013.01); *F21V 23/06* (2013.01); *H05B 45/00* (2020.01); *F21Y 2115/10* (2016.08)

(58) Field of Classification Search

CPC .. F21V 33/0068; F21V 23/007; F21V 23/023; F21V 23/06; H05B 45/00; A61G 5/10; F21S 9/02; F21Y 2115/10

USPC ..... 362/120, 157, 183

See application file for complete search history.

(56) References Cited

U.S. PATENT DOCUMENTS

| | | | | |
|---|---|---|---|---|
| 5,014,946 | A * | 5/1991 | Gruber | A47G 23/0216 248/205.3 |
| 5,349,340 | A | 9/1994 | Blumenthal | |
| 2002/0069905 | A1 | 6/2002 | Collins | |
| 2012/0285026 | A1 * | 11/2012 | Min | B60Q 1/50 33/264 |

(Continued)

FOREIGN PATENT DOCUMENTS

| | | |
|---|---|---|
| CN | 104905 917 | 9/2015 |
| CN | 205549235 U | 9/2016 |

(Continued)

*Primary Examiner* — Wei (Victor) Y Chan

(74) *Attorney, Agent, or Firm* — Hartman Titus PLC; John D. Titus

(57) ABSTRACT

Wheelchair lighting control unit 1 comprising a housing to; control electronics 28 for driving at least one LED light of a wheelchair, the control electronics being arranged in the housing to; and a power supply unit 40 for supplying power to the wheelchair lighting control unit 1; said housing to having a power supply unit compartment 14 for receiving said power supply unit 40, said power supply unit compartment 14 being always open on a side wall of said housing to so that said power supply unit 40 can be inserted into and withdrawn from said power supply unit compartment 14; and said power supply unit 40 being releasably held in the power supply unit compartment 14 in the inserted position by means of at least one magnet 70, 72 and/or by means of at least one spring element 16, 18, 76 which is biased from the outside against a side face of the power supply unit 40.

20 Claims, 11 Drawing Sheets

(56) References Cited

U.S. PATENT DOCUMENTS

Figure 1:
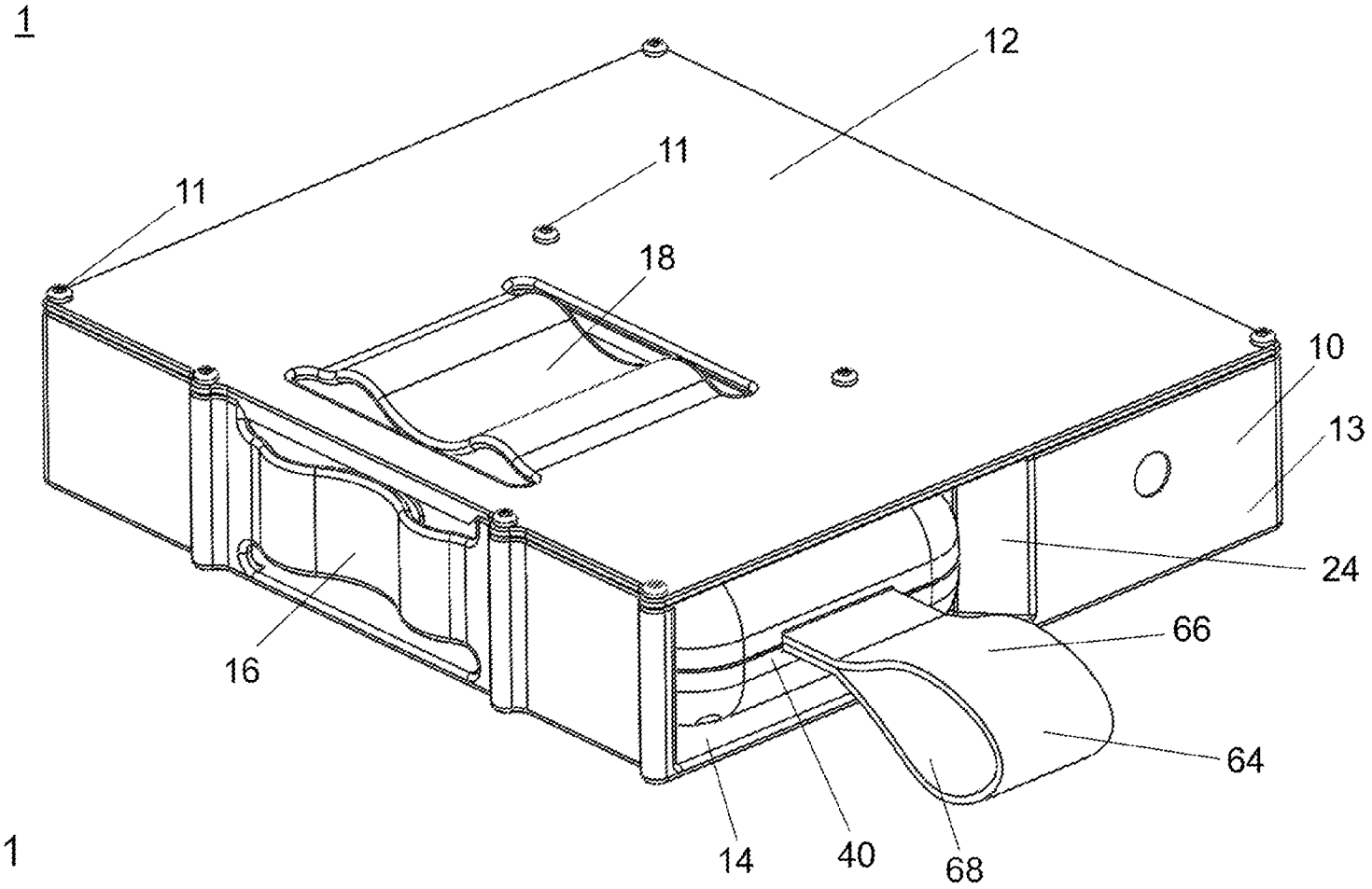

| | | | | |
|---|---|---|---|---|
| 2015/0039042 | A1* | 2/2015 | Amsler | A61N 1/3993 607/7 |
| 2017/0207429 | A1* | 7/2017 | Wang | F21V 23/0414 |

FOREIGN PATENT DOCUMENTS

| | | | |
|---|---|---|---|
| DE | 295 19 209 | U1 | 4/1996 |
| DE | 201 15 783 | U1 | 4/2002 |
| DE | 100 64 426 | A1 | 7/2002 |
| DE | 20 2014 103 134 | U1 | 10/2014 |
| DE | 10 2015 111 923 | A1 | 3/2016 |

* cited by examiner

WHEELCHAIR LIGHTING CONTROL UNIT

1. TECHNICAL FIELD

The present invention relates to a wheelchair lighting control unit for wheelchair lighting and a wheelchair with such a wheelchair lighting control unit.

2. PRIOR ART

Wheelchairs are technical aids that enable a person with limited mobility to be independently mobile in a larger environment. A wheelchair can be designed as a manual or electric wheelchair. In the case of a manual wheelchair, the wheelchair user drives the two large wheels of the wheelchair with his own arms. In the case of an electric wheelchair, the wheelchair user need only actuate an appropriate control device on the wheelchair to move the wheelchair. An electric motor on the wheelchair then drives the wheels.

The electric motor on the wheelchair is powered by a power source which is also located on the wheelchair. This power source is usually a rechargeable accumulator. Due to the existing power source, electric wheelchairs often have lighting to increase the visibility and traffic safety of the electric wheelchair. The lighting is often mounted on the side armrests of the wheelchair and essentially radiates light forward so that the wheelchair user can be seen from afar.

The movement of the wheelchair is essentially dependent on the characteristics of the floor on which the wheelchair is moved. A comfortable movement of the wheelchair is usually possible on flat surfaces such as asphalt or paved roads and sidewalks. Small unevenness on the way are dampened by the rubber tires of the wheelchair and can be driven over. Larger unevenness, such as potholes or larger stones, can, however, lead to a significant reduction in comfort and, in the worst case, can cause the wheelchair to tip over. Particularly in restricted or poor visibility conditions, such as at dusk or in the dark, such unevenness can pose a serious hazard to the wheelchair user.

There are therefore various concepts for equipping manual wheelchairs with light sources. In the case of electric wheelchairs, the lighting is supplied by the power source of the drive. However, manual wheelchairs have no drive and therefore no power supply. A power source must therefore be provided to supply the illuminants.

For example, the document CN 104 905 917 A shows lighting for a wheelchair in which the power supply is locally integrated into the respective lighting equipment. Therefore, changing or charging accumulators or batteries is laborious and usually not feasible for the user of the wheelchair himself.

In addition to the power source, lights for a wheelchair have an electric switch to turn the lights on and off. As shown in CN 104 905 917 A, these switches are often attached to the illuminant itself. Therefore, even switching the lighting on or off may be unergonomic or even impossible for more limited users, so that such lighting means cannot be used in practice.

It is therefore a task of the present invention to provide a power supply for the lighting of a wheelchair which overcomes the above problems.

3. SUMMARY OF THE INVENTION

The above problems are solved according to the invention by a wheelchair lighting control unit according to claim 1.

In particular, the aforementioned problems are solved by a wheelchair lighting control unit comprising a housing, a control electronics for controlling at least one LED light of a wheelchair, the control electronics being arranged within the housing, and a power supply unit for supplying power to the wheelchair lighting control unit, the housing comprising a power supply unit compartment for receiving the power supply unit, which is always open on a side wall of the housing, so that said power supply unit can be inserted into and withdrawn from said power supply unit compartment, wherein said power supply unit being releasably held in the inserted position within said power supply unit compartment by means of at least one magnet and/or by means of at least one spring element which is biased from the outside against a side surface of the power supply unit.

Through the side opening in the housing of the wheelchair lighting control unit, the power supply unit can be easily removed by the user and then connected to a charging cable in the user's field of vision or placed on a charging station to charge the preferably rechargeable power supply unit. Since the power supply unit can be easily removed, the wheelchair lighting control unit can preferably be mounted below the seat of the wheelchair. A direct view onto the wheelchair lighting control unit is therefore not necessary. Connecting a charging cable to a power supply unit permanently installed in the wheelchair lighting control unit, which would be difficult for users with limited motor skills of the hand, can be avoided.

The fixation of the power supply unit within the power supply unit compartment by at least one magnet, in particular a permanent magnet, preferably a neodymium permanent magnet, saves the user an active actuation of a release device, for example a release of detents, etc. The same applies to fixing the power supply unit within the power supply unit compartment by means of a spring element at or in the power supply unit compartment. In addition, the power supply unit can be pulled out and inserted into the power supply unit compartment, which is open on one side, even without a direct view onto the wheelchair lighting control unit, by persons with limited hand motor skills, and is much easier than, for example, positioning a charging cable at a plug connection that is difficult to see. Overall, therefore, the replacement or recharging of a power supply unit of a wheelchair lighting system can be easily and safely done by the user himself. In particular, the user can also pull the power supply unit out of the power supply unit compartment with just one finger.

Despite the fact that the power supply unit can be easily changed by pulling it out and inserting it into the power supply unit compartment, the at least one magnet or the at least one spring element in the power supply unit compartment holds it securely and permanently during use of the wheelchair. The design of the magnet or spring allows a precisely defined magnetic holding force or friction force, respectively, to be generated which holds the power supply unit securely in the wheelchair lighting control unit and thus ensures its operability. In particular, the power supply unit in the wheelchair lighting control unit is secured and fixed against vibrations during operation. The magnet and/or spring element is preferably designed in such a way that a tensile force of approx. 15 to 40 N, particularly preferably 20 to 30 N, is required to pull the power supply unit out of the power supply unit compartment. The at least one magnet and/or the at least one spring element can preferably additionally prevent the power supply unit from rattling within the power supply unit compartment in the event of vibrations.

The wheelchair lighting control unit may be equipped with either at least one magnet or at least one spring element for releasably holding the power supply unit in the power supply unit compartment. Furthermore, the wheelchair lighting control unit may also be equipped with at least one magnet and at least one spring element, the holding effects of which complement each other.

Preferably, the power supply unit is a rechargeable power supply unit containing one or more accumulators and supplies power to the control electronics and at least one LED light connected thereto. The control electronics at least serve to switch the LED light on and off and can have further functions for controlling the wheelchair lighting.

Preferably, the housing also protects the control electronics from shocks, dust, moisture and other influences and is therefore waterproof or at least splash-proof. In particular, the part of the housing containing the control electronics is sealed against the open power supply unit compartment.

Preferably, the at least one magnet is combined with the electrical connection of the power supply unit to the control electronics. Accordingly, it is not necessary to use a separate magnet, but an electrical contact connection can be used which already contains at least one magnet. This simplifies the installation of the wheelchair lighting control unit.

Preferably, the at least one magnet is arranged at one end wall of the power supply unit or at the closed end of the power supply unit compartment. Thus, the attraction of at least one magnet acts at the end of the insertion process of the power supply unit into the power supply unit compartment.

Preferably, at least two counter-pole magnets are provided, wherein one magnet is arranged at the power supply unit and one magnet is arranged at the power supply unit compartment, so that the two magnets attract each other when the power supply unit is in the inserted position. By using two magnets, the attraction force can be increased. Alternatively, only one magnet is provided which interacts with a ferromagnetic counterpart.

The fixing by the spring element is mainly based on the principle of friction. Alternatively or additionally, the spring can also engage in recesses on the outside of the power supply unit.

The at least one spring is preferably designed as a band spring, which has an undulating cross-section. Compared to other forms of a spring, the band spring is comparatively narrow and can therefore be accommodated more easily in or on the power supply unit compartment. In addition, the undulating shape of a band spring allows the power supply unit to slide easily along the spring. The wavy shape also allows the spring effect to be adjusted and maintained permanently without premature signs of fatigue.

Preferably, the at least one spring is formed in one piece with the power supply unit compartment and replaces a part of the wall of the power supply unit compartment. This eliminates the need for a complex connection and the time-consuming installation of a separate spring on the inside of the power supply unit compartment. In addition, the spring and the power supply unit compartment do not have to be manufactured separately, which reduces the manufacturing effort.

The power supply unit compartment preferably has two spring elements which are arranged at an angle to each other and which are preloaded from the outside against two different side surfaces of the power supply unit. Due to the different orientation of the springs, the power supply unit is pressed against two inner surfaces of the power supply unit compartment opposite the springs and thus occupies a defined position. This ensures that the power supply unit is electrically connected to the control electronics via an electrical plug connection at the closed end of the power supply unit compartment during each insertion process. Since the two springs provide accurate positioning of the power supply unit, the power supply unit compartment can be designed with some clearance with respect to the power supply unit, making it easier for the user to insert and remove the power supply unit into and out of the power supply unit compartment.

Preferably the at least one spring is made in one piece with the power supply unit compartment. Particularly preferred is the at least one spring made of a plastic material injection moulded in one piece with the power supply unit compartment. The fact that the spring is manufactured in one piece with the power supply unit compartment, in particular injection-moulded from a plastic material, means that there is no need for separate manufacture and assembly of a spring. Plastic is particularly well suited as a material for the spring, as its elastic properties can be selected by selecting a suitable plastic material. This allows a spring with a precisely defined spring force to be provided. Furthermore, a production by injection moulding process is particularly suitable for the production of a housing with complex geometry and high quantities. In addition, a spring made of plastic material is particularly resistant to corrosion.

Preferably, the at least one spring forms a part of an outer wall visible from the outside. Thus, the spring also forms part of the outer wall of the power supply unit compartment, so that no additional wall area of the power supply unit compartment is required at this point. This keeps the complexity of the housing as low as possible and eliminates the need for additional components and possible assembly steps. In addition, the condition of the springs can be checked visually.

Preferably, the at least one spring in cross-section has at least three circular arc sections which are alternately arranged convexly and concavely, the second circular arc section being concave when viewed from the outside and aligned against the side surface of the power supply unit. Such a design is particularly suitable for a permanent spring to hold the power supply unit.

A foil with a low-friction surface is preferably arranged on the surface of at least one spring facing the power supply unit. The low-friction surface of the foil reduces the friction resistance when the power supply unit is inserted into the power supply unit compartment, thus reducing the force required. Thus, the required force can be precisely adjusted.

The spring element is preferably designed as a wire bracket and simultaneously pretensioned on opposite side surfaces of the power supply unit. The wire bracket allows the spring effect of the spring element to be adjusted particularly precisely. This results in a particularly reliable fixation of the power supply unit on the one hand and on the other hand the power supply unit can still easily be pulled out of the power supply unit compartment.

The control electronics preferably comprise a circuit board on which cable clamps or electrical plug connectors are arranged for tool-free contacting of electrical cables leading to at least one LED light. With cable clamps or plug connectors, preferably jack sockets and corresponding jack plugs, for tool-free contacting of electrical lines, the wheelchair lighting control unit can be easily connected via electrical lines or cables to LED lights which are attached to the wheelchair at a suitable location.

Foils with a low-friction surface are preferably arranged on the inside of the power supply unit compartment. Due to the low-friction surface of the foil on the inside of the power supply unit compartment, the friction resistance is reduced when the power supply unit is inserted into the power supply unit compartment and the force required is thus reduced and can be precisely adjusted.

Preferably, the housing has a lead-in chamfer adjacent to the opening of the power supply unit compartment. This lead-in chamfer allows a larger tolerance when applying the power supply unit to the open end of the power supply unit compartment and thus allows the power supply unit to be inserted into the power supply unit compartment even without direct eye contact with its open end. Furthermore, the greater tolerance during the application of the power supply unit supports the use by users with limited motor skills.

Electrical contacts, in particular plug contacts or magnetic contacts, are preferably arranged at the closed end of the power supply unit compartment for the electrical connection of the power supply unit to the control electronics. Due to this position, the contacts are well protected as far as possible by the housing against external influences such as dirt. In addition, automatic contacting takes place after the power supply unit has been fully inserted into the power supply unit compartment. If magnetic contacts are used, their magnetic attraction serves simultaneously for electrical contacting and mechanical fixing of the power supply unit within the power supply unit compartment.

The power supply unit preferably has a rectangular power supply unit housing with rounded edges. These rounded edges facilitate an easy insertion of the power supply unit into the power supply unit compartment and also reduce the risk of injury when handling the power supply unit.

The power supply unit preferably has an LED charge status indicator, a magnetically connectable charging connector and a socket for the electrical connection of the power supply unit to the control electronics. By using a magnetically connectable charging connector, charging of the power supply unit by means of a cable is possible without the user having to insert a suitable charging plug into a charging socket. The magnetically connectable charging connector positions itself automatically, preferably by magnetic attraction, so that precise alignment is no longer necessary. This allows a user with limited hand motor skills to charge the power supply unit.

The power supply unit preferably has a loop, in particular a band loop, for pulling the power supply unit out of the power supply unit compartment. The position of the power supply unit below the seat surface can be easily felt through the band loop. In addition, the loop or band loop is easy to grasp and is particularly suitable for users with limited motor skills of the hand. In addition, a loop or band loop does not present a risk of injury, especially if the loop or band loop is made of a textile material.

Preferably, the loop or power supply unit housing has an optical mark on the outside that visually identifies the top of the power supply unit. The optical marking enables the correct orientation of the power supply unit before insertion into the power supply unit compartment and thus ensures successful contacting of the power supply unit with the electrical connection at the closed end of the power supply unit compartment. By placing an optical mark on the upper side of the loop, the correct orientation can be easily recognized even from the seated position of the user.

Preferably, the power supply unit has a handle for pulling the power supply unit out of the power supply unit compartment, wherein the handle preferably has an opening extending substantially vertically through the handle. The handle makes it particularly easy to pull the power supply unit out of the power supply unit compartment. The vertical orientation of the opening allows it to be pulled out even by users with limited hand mobility. A finger can easily be inserted into the vertical opening from above to grip the power supply unit and pull it out or insert it.

The power supply unit preferably comprises a USB power bank which is integrated into the power supply unit housing, whereby the connections of the USB power bank are electrically connected to the magnetically connectable charging connection and the socket, in particular electrically connected via electrical plug connectors. Using a self-contained and functional USB power bank reduces the development and manufacturing effort of a power supply unit, since functions such as a charge level indicator and charge and discharge control are already integrated into the USB power bank.

Preferably, the power supply unit has a mechanical pushbutton which can actuate a charge state pushbutton of the USB power bank and which is actuated by the power supply unit compartment when the power supply unit is inserted into and removed from the power supply unit compartment. The mechanical button allows the USB power bank charge level indicator to be activated by the power supply unit compartment. By activating the charge level indicator when pulling it out, the user no longer has to search for the pushbutton and press it separately.

In another preferred version, the USB power bank is always kept in standby mode.

Preferably, the power supply unit housing has at least one window through which the LED charge status indicator of the USB power bank is visible.

In another preferred embodiment without a USB power bank, the power supply unit in the power supply unit housing includes one or more accumulators, such as a lithium-ion accumulator. In addition, the power supply unit may also have charging electronics and/or a charge level indicator for the accumulator(s).

The housing preferably has an openable cover and a non-conductive cover below the cover, which covers the control electronics, apart the area of the terminals, from above. The non-conductive cover below the openable cover allows the power cable of an LED lighting to be connected to the terminals without coming into contact with the sensitive control electronics. This prevents accidental damage to the control electronics.

Preferably, the housing further comprises eyelets for attaching the wheelchair lighting control unit to a wheelchair. The eyelets allow the wheelchair lighting control unit to be easily and securely attached to a component of the wheelchair. The wheelchair lighting control unit can thus be fastened particularly advantageously by means of cable ties to belts of a seat covering of a wheelchair.

The eyelets are preferably one-piece with a part of the housing made of a plastic material. In particular, the eyelets are injection moulded in one piece with the lower part of the housing. This means that no further assembly step is required to attach the eyelets to the housing.

Preferably, the housing still has several recesses at its edge for fastening the wheelchair lighting control unit to a wheelchair. The recesses can be gripped using appropriate clamps or other fasteners to securely attach the wheelchair lighting control unit to the wheelchair. A large number of recesses are preferred, so that there is a geometric variability in the fastening.

The power supply unit compartment preferably has at least one rib running in the insertion direction which corresponds to at least one groove on the upper side of the power supply unit in order to ensure a definite orientation of the power supply unit within the power supply unit compartment.

4. SHORT DESCRIPTION OF THE FIGURES

Figure 2:
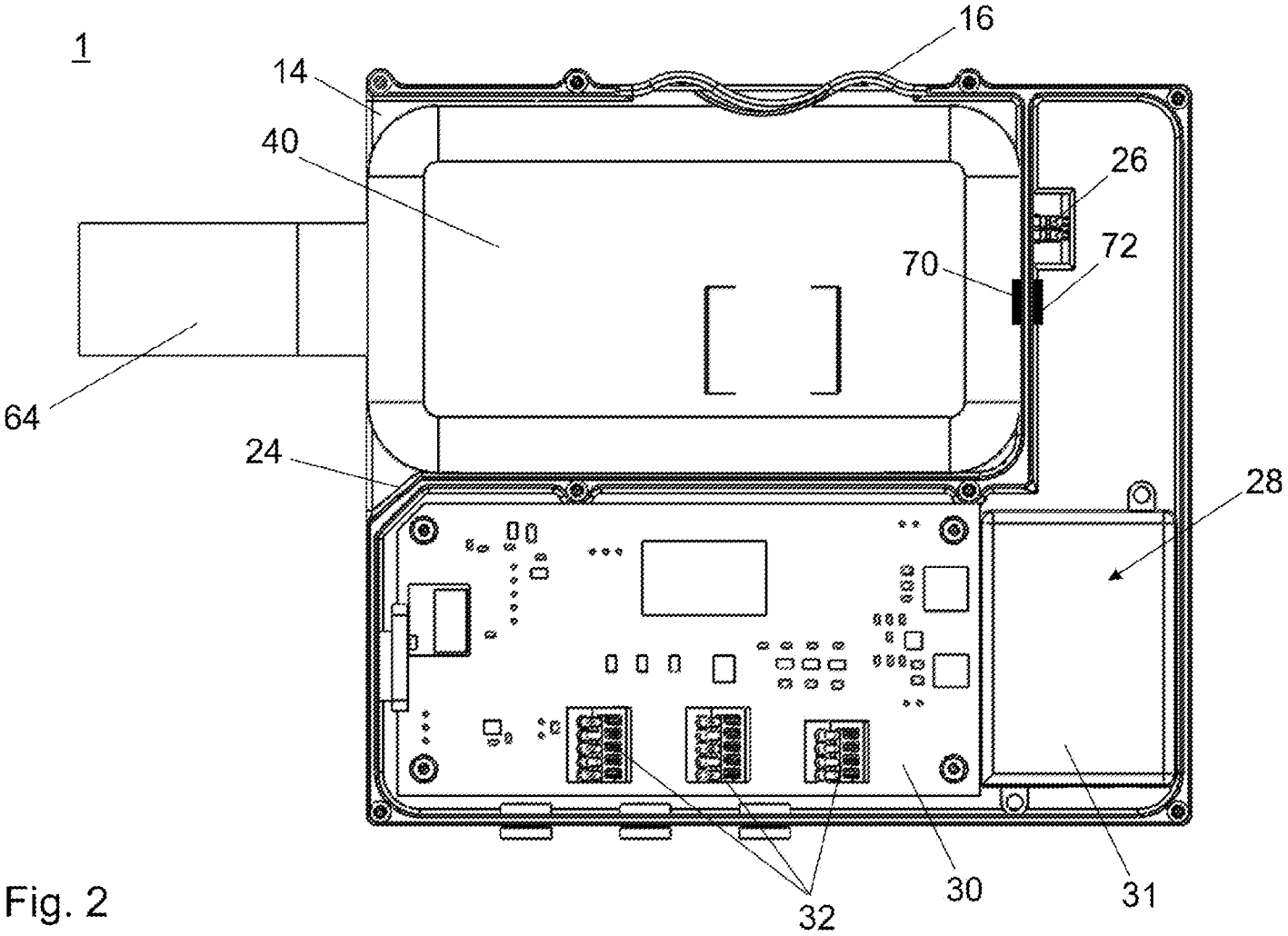
Figure 3:
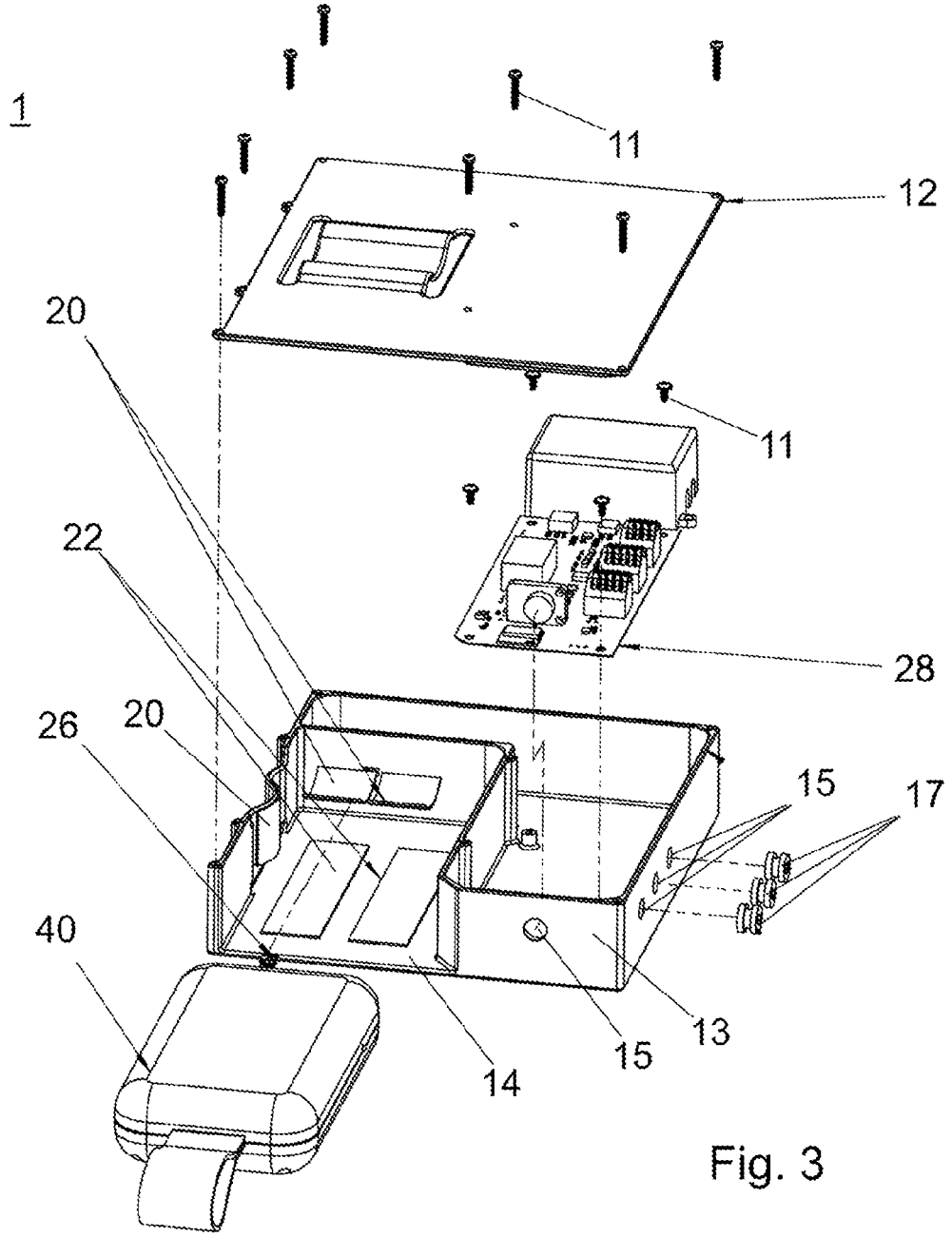
Figure 4:
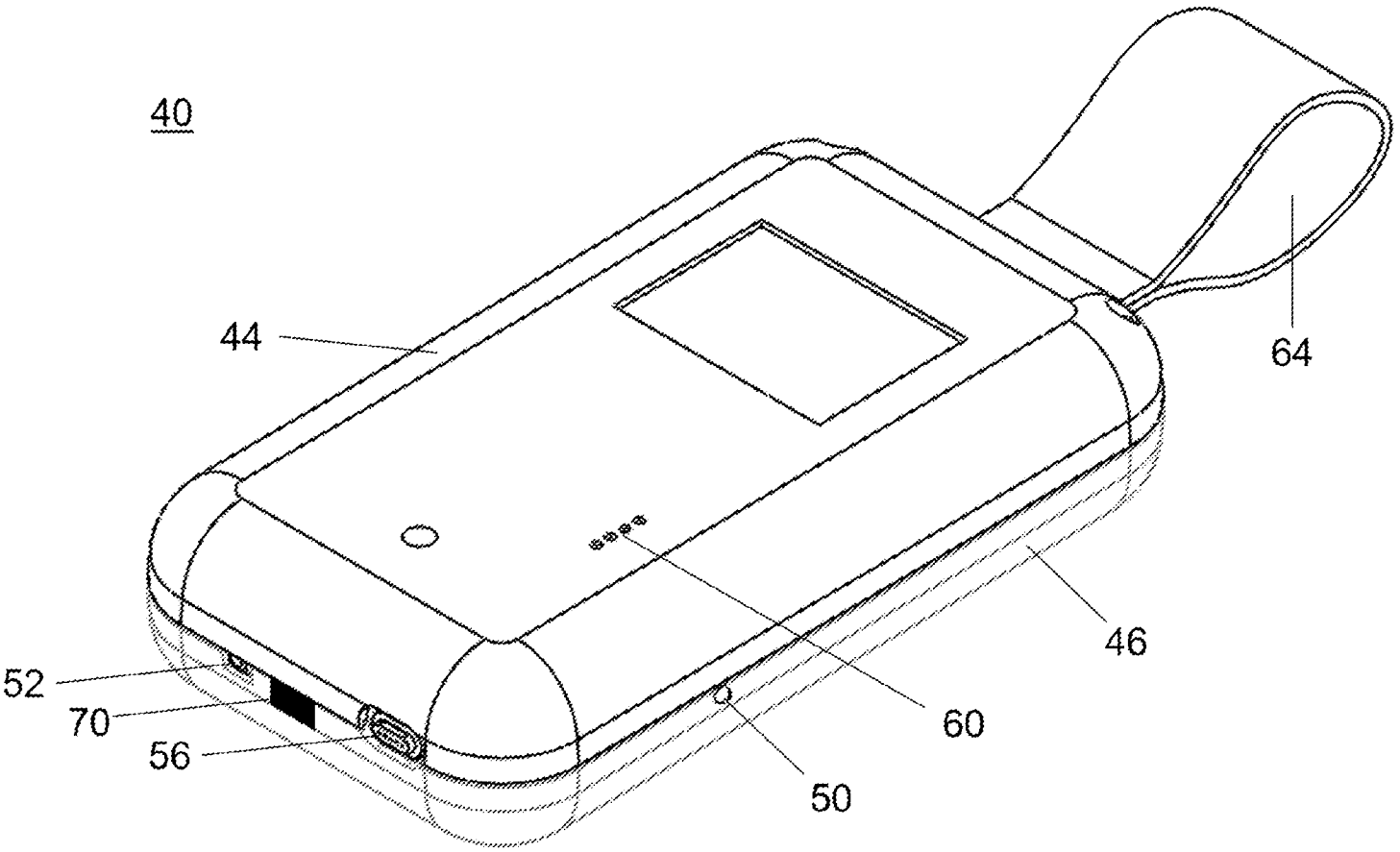
Figure 5:
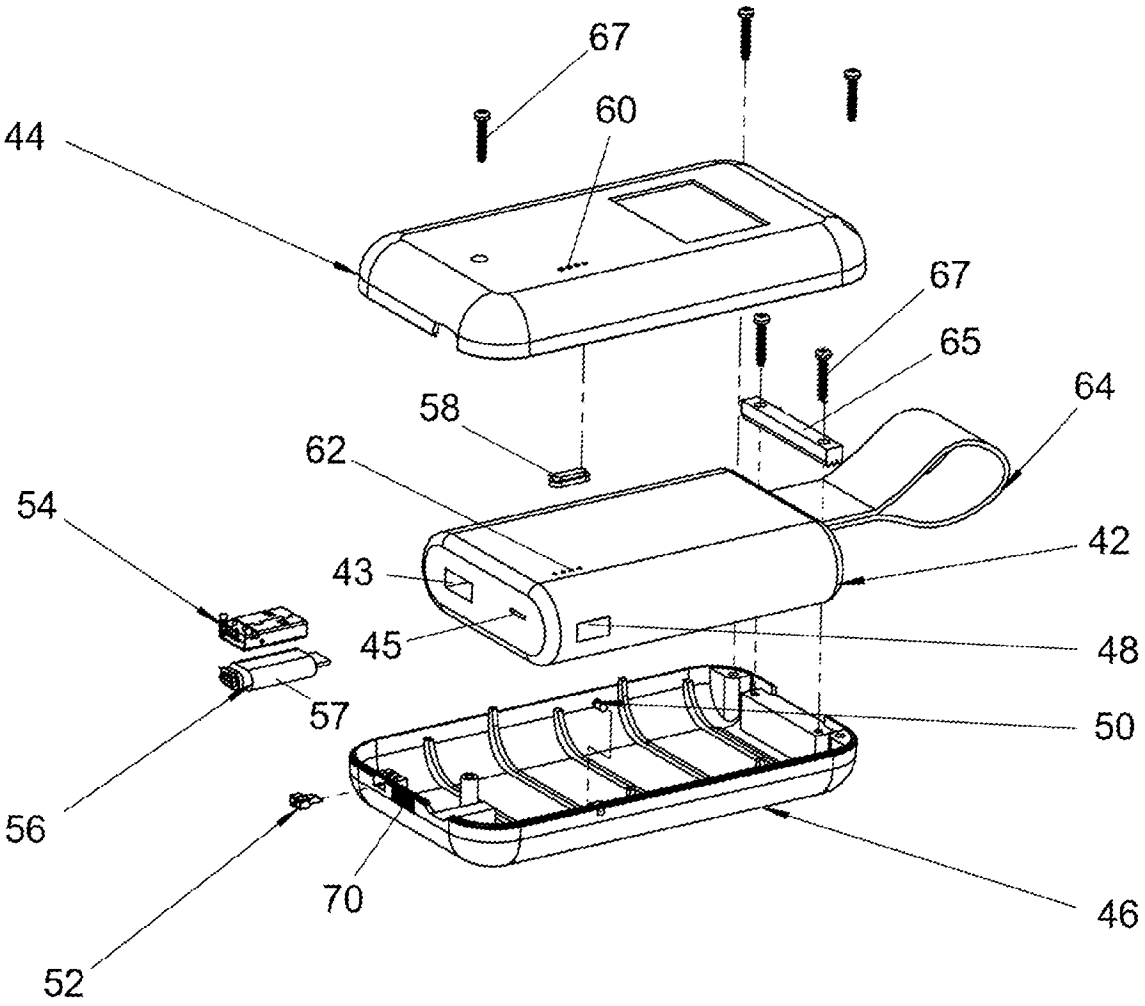
Figure 6:
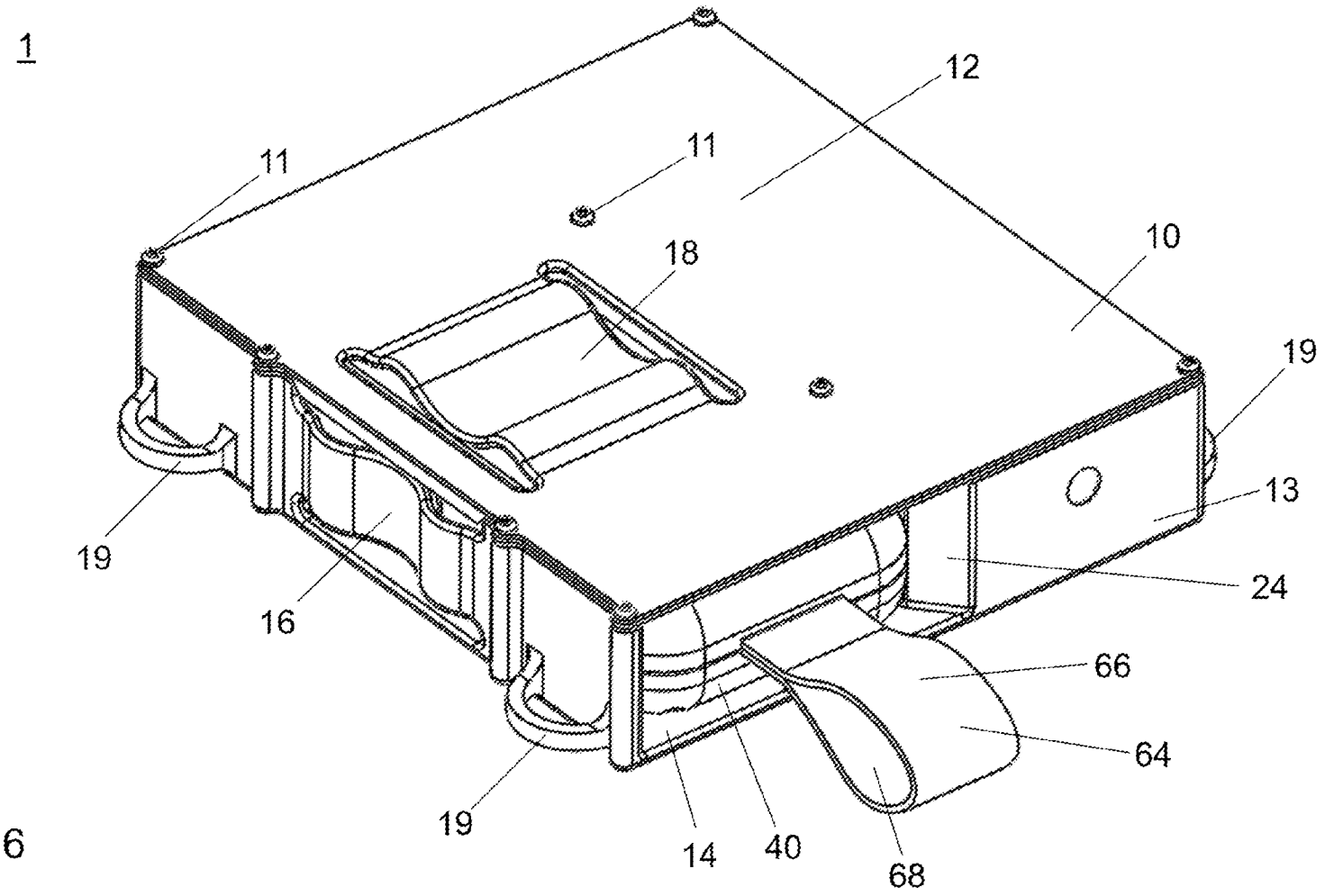
Figure 7:
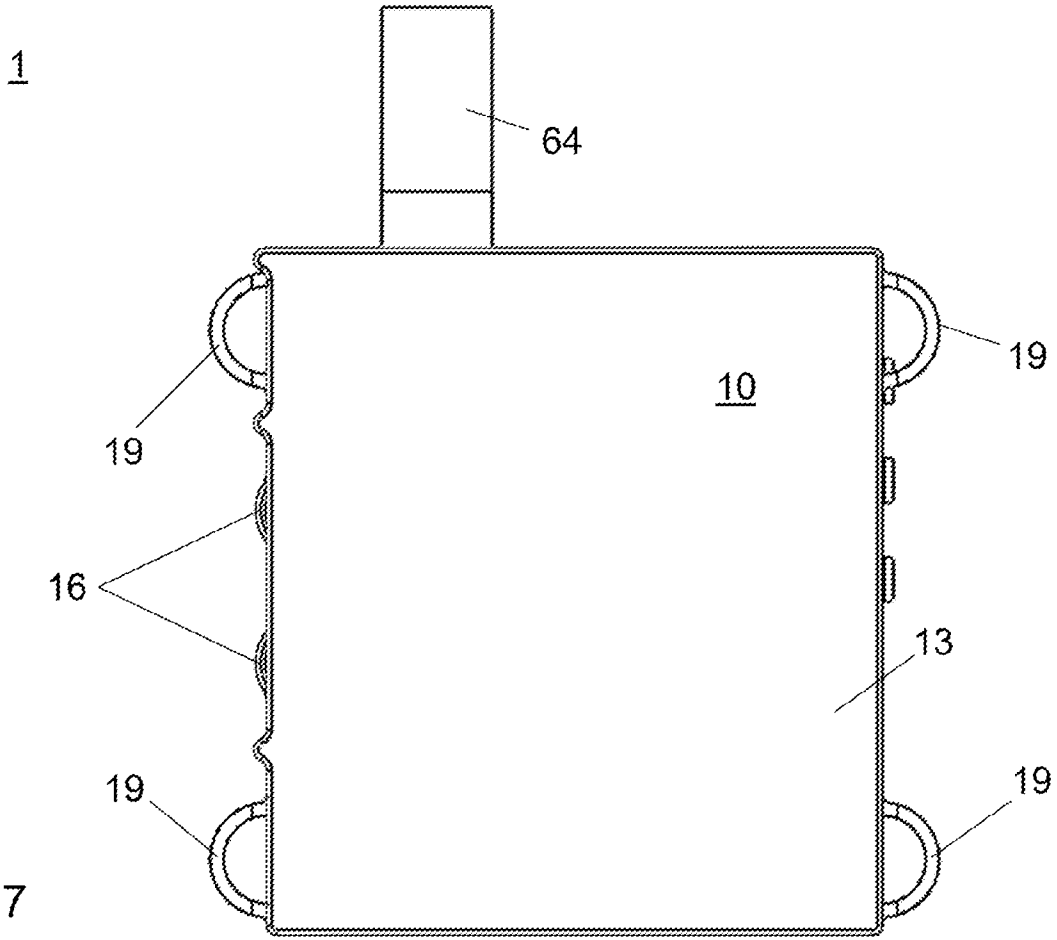
Figure 8:
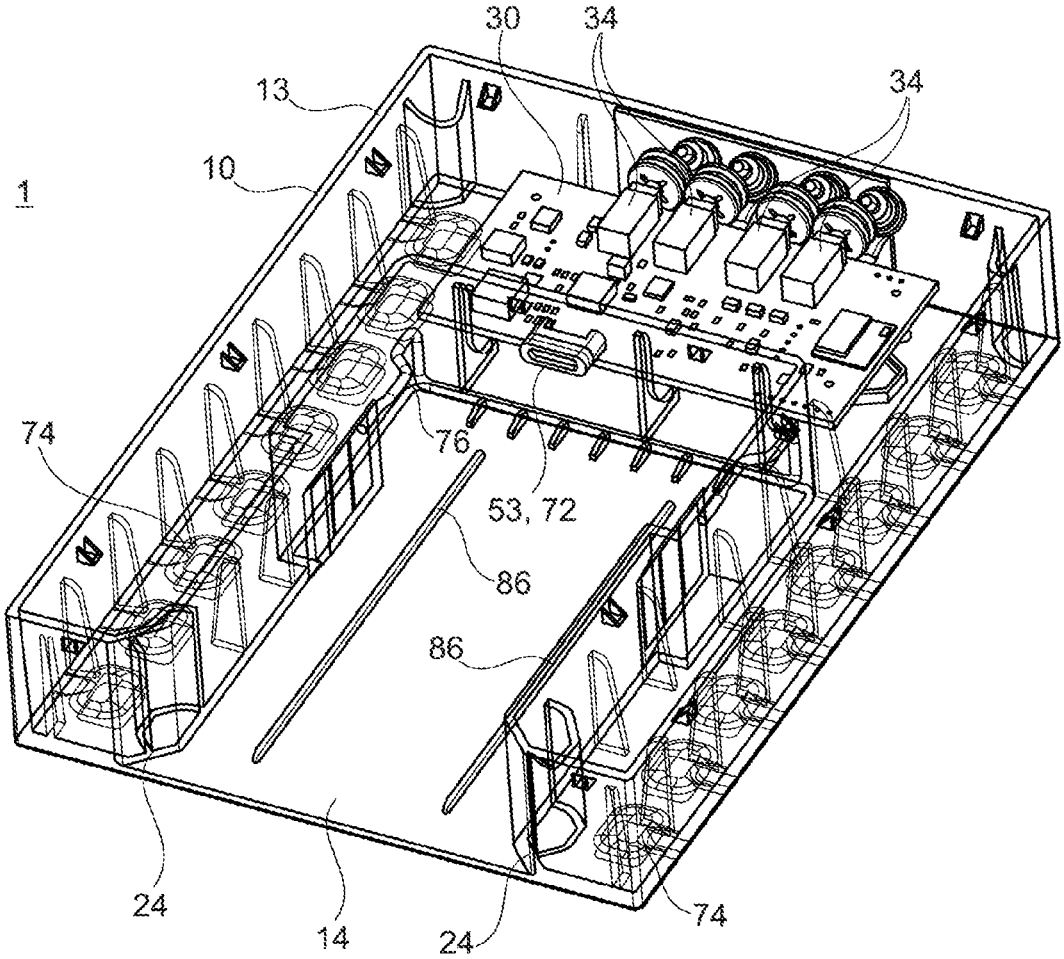
Figure 10:
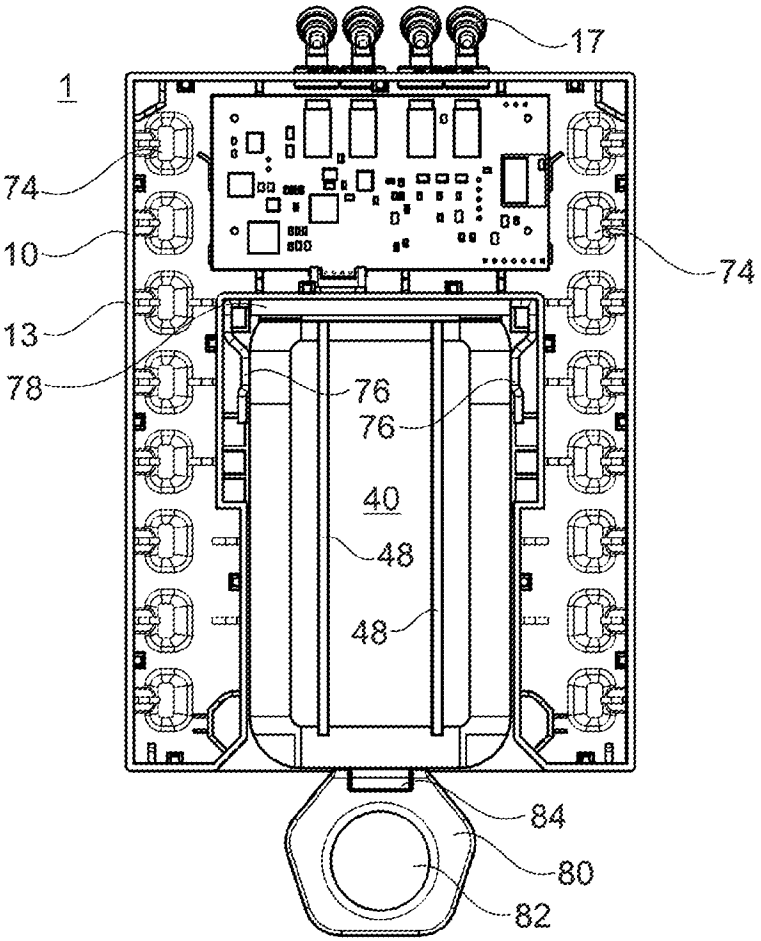
Figure 9:
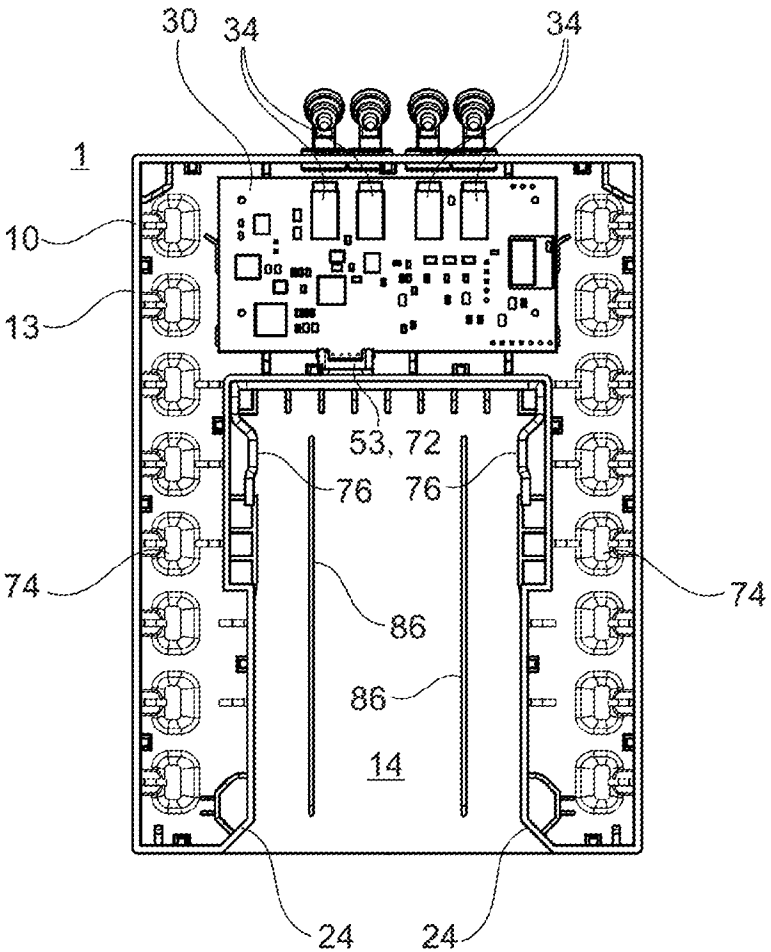
Figure 11:
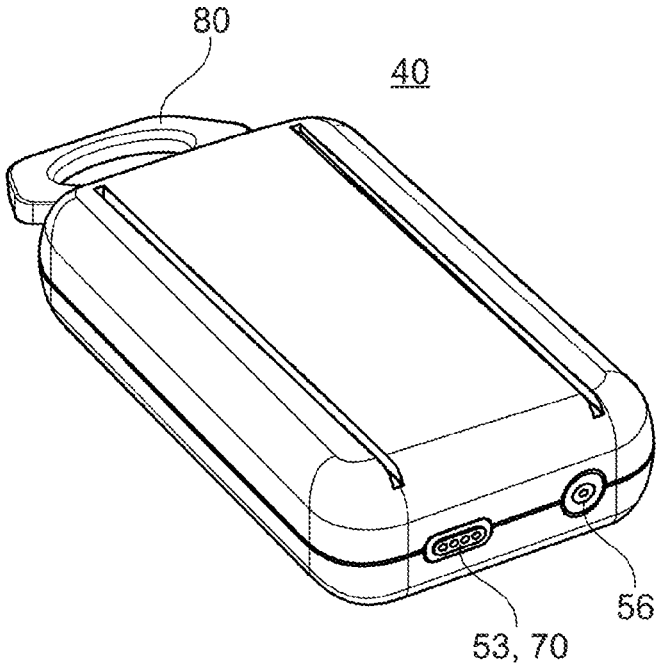
Figure 12:
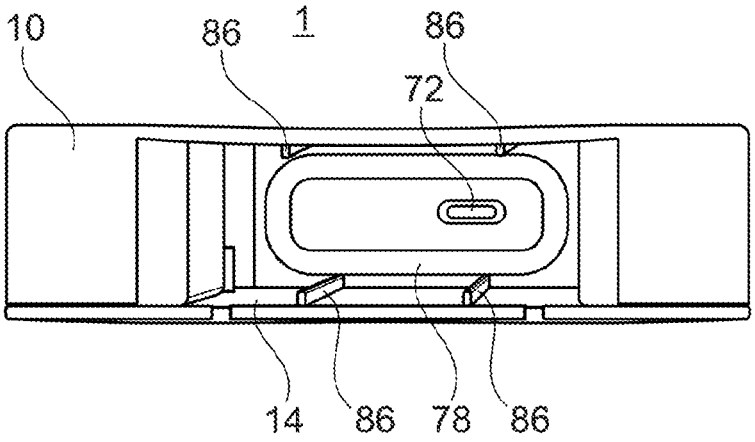
Figure 13:
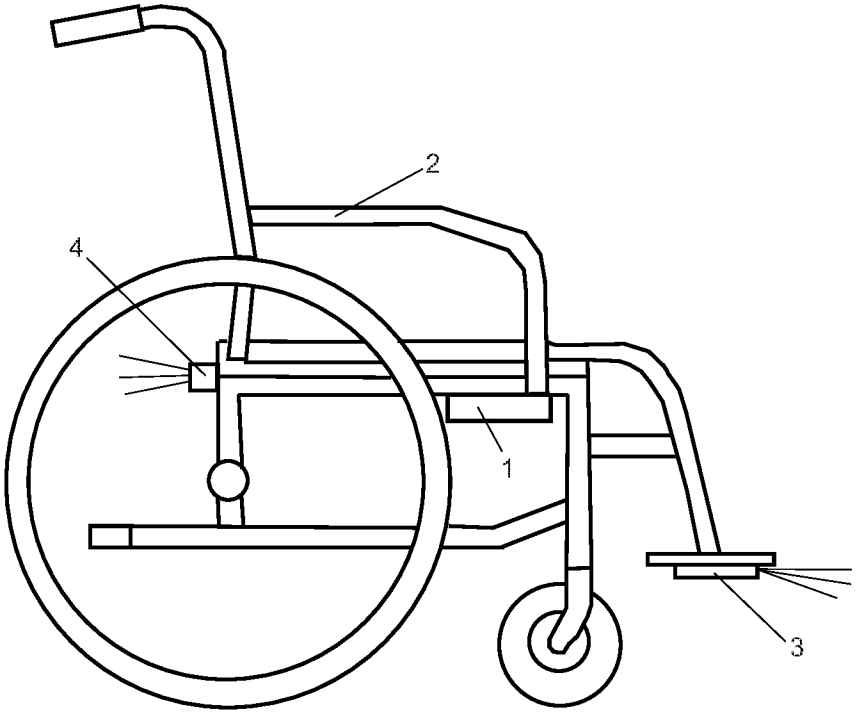

In the following, the preferred embodiments of the present invention are described by means of the attached figures. It shows FIG. 1 a perspective view from the front of a first preferred embodiment of the wheelchair lighting control unit;

FIG. 2 a view from above of the embodiment of the wheelchair lighting control unit from FIG. 1;

FIG. 3 an exploded view of the embodiment of the wheelchair lighting control unit from FIG. 1;

FIG. 4 a perspective view from the front of a preferred embodiment of a power supply unit;

FIG. 5 an exploded view of an embodiment of the power supply unit from FIG. 4;

FIG. 6 a perspective view from the front of a second preferred embodiment of the wheelchair lighting control unit;

FIG. 7 a view of the top of the embodiment of the wheelchair lighting control unit of FIG. 6; and FIG. 8 a perspective, partially transparent view of a third preferred embodiment of the wheelchair lighting control unit, with a cover removed for display reasons;

FIG. 9 a top view of the wheelchair lighting control unit according to FIG. 8;

FIG. 10 a top view of the wheelchair lighting control unit according to FIG. 8, with the power supply unit inserted;

FIG. 11 a perspective view of another embodiment form of a power supply unit;

FIG. 12 a front view of the third embodiment of the wheelchair lighting control unit; and FIG. 13 a simplified side view of an illustrative wheelchair with the wheelchair lighting control unit installed.

5. DETAILED DESCRIPTION OF PREFERRED EMBODIMENTS

In the following, preferred embodiments of the present invention are described in detail with reference to the attached figures.

FIG. 1 shows a three-dimensional view of a wheelchair lighting control unit 1 for controlling LED wheelchair lighting (FIG. 13). In addition to the wheelchair lighting control unit 1, the wheelchair lighting system preferably includes a front white LED light, a rear red LED light and, if necessary, other LED lights that illuminate the wheelchair at other points. These LED lights 3, 4 are connected via electrical lines to the wheelchair lighting control unit 1 and are suitably controlled by it.

The wheelchair lighting control unit 1 comprises a housing 10 surrounding control electronics 28 and a power supply unit 40 for power supply. The power supply unit 40 is preferably a rechargeable power supply unit and can be inserted into a power supply unit compartment 14, which is part of the housing 10 and is open on one side wall of the housing 10.

The housing comprises a lead-in chamfer 24 adjacent to the opening of the power supply unit compartment 14 for facilitating introduction of the power supply unit 40 into the power supply unit compartment 14 by the user.

The housing 10 is preferably injection moulded from plastic or machined from a metal or manufactured by a rapid prototyping process and has a removable cover 12 and a lover part or base 13. The cover 12 is detachably connected to the lower part 13 in particular by screws 11. In the embodiment of FIG. 1, the cover 12 forms an entire surface of one side of the housing 10. The cover 12 preferably forms the underside of the housing 10, as the wheelchair lighting control unit 1 can preferably be attached to the seat of a wheelchair from below by means of the lower part 13. In the embodiment of FIG. 1, the cover 12 also comprises a wave-shaped band spring 18, which is an integral part of the cover 12 and thus of the housing 10. Furthermore, a wave-shaped band spring 16 is provided on the lower part 13, which, like the band spring 18, is pretensioned from the outside against a side surface of the power supply unit 40 in order to removably hold it by friction.

In an alternative embodiment (not shown), the complete power supply unit compartment 14 and the two wave-shaped band springs 16 and 18 are an integral part of the lower part 13 of the housing 10. In this embodiment, the cover 12 essentially only covers the area of control electronics 28.

The springs 16 and 18 are preferably formed as band springs 16 and 18 and have an undulating cross-section. The undulating cross-section of the band springs 16 and 18 can consist of three or more, for example five, alternately arranged circular arc sections. In the embodiment shown, the cross-section consists of five circular arc sections which merge continuously into one another. The circular arc sections are arranged alternately concave and convex. Preferably, a central section of the arc is concave when viewed from the outside, so that the central area of the band springs 16 and 18 touches the power supply unit 40. The band springs 16 and 18 exert a defined force on the power supply unit 40.

The springs 16 and 18 preferably form externally visible parts of the outer walls of the housing 10. In an alternative embodiment, the springs 16 and 18 are arranged on the inside of closed outer walls of the housing 10 in the area of the power supply unit compartment 14. Thereby, the power supply unit 40 is better protected against splash water.

In another embodiment, springs 16 and 18 are made of a spring steel plate which is fastened to housing 10. In particular, springs 16 and 18 may be mounted on two inner sides of the power supply unit compartment 14.

The housing 10 is mounted on the seat of the wheelchair (FIG. 13) so that the cover 12 faces the floor. A loop 64 connected to the power supply unit 40 points with its upper side 68 towards the user. The strap 64 is preferred as a band loop 64 preferably consists of a flexible strap, fabric, felt or leather and serves the user to easily pull the power supply unit 40 out of the case 10. The band loop 64 protrudes out of the case 10 and preferably protrudes over the seat of the wheelchair so that the user can pull the power supply unit 40 out by means of the band loop 64 even when seated. An optical mark on the upper side 68 of the band loop 64 indicates the correct insertion position of the power supply unit 40 to the user. In addition or alternatively, an optical mark, such as a logo or similar, may also be placed on the upper side of the housing 44, 46 of the power supply unit 40.

FIG. 2 shows a view of the wheelchair lighting control unit 1 from FIG. 1 with cover 12 removed. The lower part 13 of the housing essentially comprises two areas; an area forming the power supply unit compartment 14 and an area for accommodating control electronics 18. The control electronics 28 serve to electrically control the wheelchair lighting. The control electronics can have a circuit board 30 and further electronic components 31. The logic circuit and further components of the control electronics 18 are arranged on board 30. For connecting cables to LED illuminants FIG. 3), the board 30 has three cable clamps 32 by which the cables can preferably be connected without tools. To protect the electronics on the board 30, a non-conductive cover (not shown) may be provided, which covers the entire upper side of the board 30 with the exception of the three cable clamps 32.

If the power supply unit 40 is located within the power supply unit compartment 14, it is electrically connected to the control electronics 28 via a plug connector 26 on the housing 10. The plug connector 26 is located at the closed end of the power supply unit compartment 14 to make electrical contact with a socket 52 on the power supply unit 40 when the power supply unit 40 is fully inserted into the power supply unit compartment 14.

The power supply unit 40 is held magnetically in the power supply unit compartment 14 in addition to the friction. Two magnets 70, 72 are preferably provided for this purpose, which are arranged with opposite poles at the power supply unit 40 and at the corresponding location at the power supply unit compartment 14 in such a way that they attract each other. Alternatively, one of the magnets 70, 72 can be omitted and replaced by a ferromagnetic counterpart. As shown, magnet 72 is arranged on the rear wall of power supply unit compartment 14, but magnet 72 can also be arranged at other points of power supply unit compartment 14, whereby it should only be ensured that the corresponding magnet 70 of the power supply unit 40 is sufficiently magnetically attracted in its fully inserted state.

FIG. 3 shows a three-dimensional exploded view with individualized components of the wheelchair lighting control unit 1 of FIG. 1. The control unit 28 can be fixed by screws 11 within the housing 10. The housing 10 can have an opening 15 in the area of the circuit board 30 on the sides of the open end of the power supply unit compartment 14, by which further functions of the wheelchair lighting control unit 1 can be realized. In the housing 10, opposite the cable clamps 32, there are three further openings 15 for the passage of the lines or cables to the LED lights, whereby the openings 15 are equipped with rubber grommets 17 for sealing.

The inner surfaces of the power supply unit compartment 14 and the band springs 16 and 18 are at least partially covered with low-friction foils 22 and 20, which reduce the friction between the power supply unit compartment 14 or the band springs 16 and 18 and the power supply unit 40 during insertion and withdrawal. The friction held by the power supply unit 40 in the housing 10 can be more precisely defined and adjusted by the material of the foils 10 and 22. Depending on the material of the springs 16, 18, of the power supply unit compartment 14 and of the housing 44, 46 of the power supply unit 40, the low-friction foils 20, 22 can also be omitted.

FIG. 4 shows a three-dimensional view of the power supply unit 40. A charging connection 56 for charging the power supply unit 40 and a plug connection 52 for supplying the control unit 28 with power are attached to the power supply unit 40. The charging connector 56 is preferably a magnetic charging connector, which can be connected to a corresponding magnetic charging cable (not shown) via magnetic attraction, in order to enable an easy to handle connection and simple charging of the power supply unit 40, also if the user has limited hand motor skills. Preferably, the magnetic charging connector 56 can also be used to magnetically fix the power supply unit 40 within the power supply unit compartment 14. For this purpose, the magnet 72 or a ferromagnetic counterpart is arranged accordingly on the rear wall of the power supply unit compartment 14.

The power supply unit 40 also has a state of charge indicator 60, which can indicate the current state of charge by means of four illuminated LED lights. A pushbutton 50 on the outside of the power supply unit 40 can be used to activate the state of charge display 60. This is preferably done when pulling out and/or inserting the power supply unit 40, whereby the push-button 50 is actuated from the inside of the power supply unit compartment 14.

FIG. 5 shows a three-dimensional exploded view of the power supply unit 40 from FIG. 4 with individualized components. The power supply unit 40 has a housing with an upper shell 44 and a lower shell 46, which are preferably screwed together. The housing 44, 46 contains in an embodiment a USB power bank 42, which comprises the actual accumulator cells and charging electronics (not shown).

A button 48 of the USB power bank 42 can be used to activate its charge level indicator 62. The charge level of the USB Power bank 42 is visible to the outside through a transparent window 58 made of a plastic material of the state of charge indicator 60 through the housing 44, 46.

In another embodiment of the power supply unit 40 (not shown), this does not have a USB power bank, but its own charging electronics and its own accumulator cells for storing electrical energy.

In both versions, the power supply unit 40 also has additional state of charge electronics (not shown), which measures the voltage at connector 52 and informs the control electronics 28 so that it can determine the current state of charge of the power supply unit 40.

As further shown in FIG. 5, a belt clamp 65 fixes the belt loop 64, whereby the belt clamp is fastened by two screws 67 at the lower shell 46.

The magnetic charging connector 57 is provided by a USB adapter 57, which is plugged into a micro-USB socket 45 of the USB power bank 42. The USB adapter 57 is fixed between the upper shell 44 and the lower shell 46.

To deliver electrical current, a USB plug 54 is plugged into a USB socket 43 of the power bank 42 and electrically contacted with socket 52, which is located on the outside of the power supply unit 40.

FIGS. 6 and 7 show another preferred embodiment of the wheelchair lighting control unit 1, which differs from the wheelchair lighting control unit 1 of FIGS. 1 to 5 only in that the housing 10 preferably comprises four eyelets 19 on its outer side. The eyelets 19 are used to attach the wheelchair lighting control unit 1 to a wheelchair. In particular, the wheelchair lighting control unit 1 can be easily but safely attached to a belt of a seat cushioning of a wheelchair by means of cable ties inserted into eyelets 19. The eyelets 19 are preferably injection molded in one piece with the lower part 13 of the housing 10 and extends from this laterally to the outside.

FIGS. 8-12 show a third preferred embodiment of the wheelchair lighting control unit 1. The third embodiment corresponds in its basic structure and functionality to the first and second embodiments already described.

The third embodiment of the wheelchair lighting control unit 1 differs from the other versions in its shape and the design of the housing 10 and the spring element 76.

The spring element 76 here is designed as an essentially U-shaped wire bracket, which is fastened by clipping into the lower part 13 of the housing. The spring element 76 can press on opposite sides of the power supply unit 40 and fix it in the power supply unit compartment 14 as shown in FIG. 10.

In the third version, a magnetic terminal 53 or magnetic contacts 53 is also provided for the electrical connection between the power supply unit 40 and the control unit 28. Due to the magnetic attraction of the respective elements, the magnetic terminal 53 or magnetic contacts 53 serve to magnetically fix the power supply unit 40 within the power supply unit compartment 14. Accordingly, the magnetic terminal 53 forms magnets 70, 72.

In the third version, plug connectors 34 are also provided, which are used for the simple connection of wires or cables to the LED lights on the board 30 of the control unit 28.

In addition, the power supply unit compartment 14 has 86 ribs running in the insertion direction, which correspond to grooves 48 on the upper side of the power supply unit 40 (see FIGS. 10 and 11), in order to ensure a definite orientation of the power supply unit 40 within the power supply unit compartment 14. For this purpose, the arrangement of the ribs 86 in the lower part 13 of the housing 10 differs from the ribs 86 in the cover 12 of the housing 10, so that it is only possible to insert the power supply unit 40 with correct orientation (Poka Yoke principle).

As shown in FIGS. 10 and 11, the power supply unit 40 now has a fixed handle 80 made of a plastic material instead of a band loop 64. The handle 80 is attached to the housing of the power supply unit 40 by means of a hinge 84. As can be seen, the handle 80 is essentially flat and horizontally aligned. The handle 80 also has an opening 80 for easy extraction of the power supply unit 40, which extends substantially vertically through the handle 80 when the power supply unit 40 is inserted into the power supply unit compartment 14.

Finally, the housing 10 of the third embodiment has a large number of opposing recesses 74 at the edge of the lower part 13 and at the edge of the cover 12. Clamps (not shown) or other fasteners may engage in these recesses 74 to attach the wheelchair lighting control unit 1 to a wheelchair. The large number of recesses 74 enables a large number of different fastening variants.

As shown in FIGS. 10 and 12, the power supply unit compartment 14 on its rear wall has a seal 78 made of an elastomer material to protect the electrical contacts of the power supply unit 40 and the power supply unit compartment 14 from environmental influences.

LIST OF REFERENCE SIGNS

1 wheelchair lighting control unit
10 case
11 screws in housing
12 cover
13 lower part of the housing
14 power supply unit compartment
15 opening in housing
16 side spring
17 Rubber grommets for sealing the housing
18 Top spring
19 eyelets
20 low-friction foil on spring
22 low-friction foil on power supply unit compartment inside
24 lead-in chamfer
26 plug contact
28 control unit
30 circuit board
31 electronic components
32 cable clamps
34 connectors
40 power supply unit
42 USB power bank
43 USB socket
44 upper power supply unit housing shell
45 micro USB socket
46 lower power supply unit housing shell
48 grooves
57 adapter
48 charging status button
50 push button
52 Socket with electrical connection to the control electronics
53 magnetic connection/magnetic contacts
54 USB connector
56 magnetic charging adapter
58 inspection windows
60 charge level indicator of the power supply unit
62 charge level indicator of the power bank
64 band loop
65 band clamp
66 lower side of the band loop
67 power supply unit screw
68 upper side of the band loop
70 magnet at power supply unit
72 magnet on power supply unit compartment
74 recesses
76 spring element
78 seal
80 handle
82 opening
84 hinge
86 ribs

The invention claimed is:

1. Wheelchair lighting control unit (1) comprising:

a. a housing (10);

b. control electronics (28) driving at least one LED wheelchair light, the control electronics being arranged in the housing (10); and c. a power supply unit (40) for supplying power to the wheelchair lighting control unit (1);

d. said housing (10) having a power supply unit compartment (14) for receiving said power supply unit (40), said power supply unit compartment (14) being always open on a side wall of said housing (10) so that said power supply unit (40) can be inserted into and withdrawn from said power supply unit compartment (14);

e. said power supply unit (40) being releasably held in the power supply unit compartment (14) in the inserted position by means of at least one magnet (70, 72) and/or by means of at least one spring element (16, 18, 76) which is biased from the outside against a side face of the power supply unit (40); and f. wherein the power supply unit (40) comprises a magnetically connectable charging terminal (56).

2. Wheelchair lighting control unit according to claim 1, wherein the at least one magnet (70, 72) is combined with an electrical terminal (27, 53) of the power supply unit (40) to the control electronics (28).

3. Wheelchair lighting control unit according to claim 1, wherein the at least one magnet (70, 72) is disposed at an end wall of the power supply unit (40) or at the closed end of the power supply unit compartment (14).

4. Wheelchair lighting control unit according to claim 1, wherein at least two oppositely poled magnets (70, 72) are provided, wherein one magnet (70) is arranged at the power supply unit (40) and one magnet (72) is arranged at the power supply unit compartment (14) such that the two magnets (70, 72) attract each other, when the power supply unit (40) is in the inserted position.

5. Wheelchair lighting control unit according to claim 1, wherein said at least one spring element (16, 18) is configured as a band spring having a undulated cross-section.

6. Wheelchair lighting control unit according to claim 1, wherein said at least one spring element (16, 18) is integrally formed with said power supply unit compartment (14) and replaces a part of a wall of said power supply unit compartment (14).

7. Wheelchair lighting control unit according to claim 1, wherein the power supply unit compartment (14) comprises two spring elements (16, 18) arranged at an angle to each other and biased from the outer side against two different side surfaces of the power supply unit (40).

8. Wheelchair lighting control unit according to claim 1, wherein a foil (20) with a low-friction surface is arranged on a surface of the at least one spring element (16, 18) facing the power supply unit (40).

9. Wheelchair lighting control unit according to claim 1, wherein the control electronics (28) comprises a circuit board (30) on which cable terminals (32) or plug connectors (34) for tool-free contacting of electrical lines to the at least one LED light are arranged.

10. Wheelchair lighting control unit according to claim 1, wherein foils (22) having a low-friction surface are disposed on the inside of the power supply unit compartment (14).

11. Wheelchair lighting control unit according to claim 1, wherein the housing (10) having an lead-in chamfer (24) adjacent the opening of the power supply unit compartment (14).

12. Wheelchair lighting control unit according to claim 1, wherein the power supply unit (40) comprises a cuboid power supply unit housing (44, 46) having rounded edges.

13. Wheelchair lighting control unit according to claim 1, wherein the power supply unit (40) comprises an LED charge state indicator.

14. Wheelchair lighting control unit according to claim 1, wherein the power supply unit housing (44, 46) has an optical mark on the outside, for optically identifying the top of the power supply unit (40).

15. Wheelchair lighting control unit according to claim 1, wherein the power supply unit (40) comprises a USB power bank (42) which is integrated into a power supply unit housing (44, 46).

16. Wheelchair lighting control unit according to claim 15, wherein the power supply unit housing (44, 46) comprises at least one window (60) through which the LED charge state indicator (62) of the USB power bank (42) is visible.

17. Wheelchair lighting control unit (1) comprising:

a. a housing (10);

b. control electronics (28) for driving at least one LED light of a wheelchair, the control electronics being arranged in the housing (10); and c. a power supply unit (40) for supplying power to the wheelchair lighting control unit (1);

d. said housing (10) having a power supply unit compartment (14) for receiving said power supply unit (40), said power supply unit compartment (14) being always open on a side wall of said housing (10) so that said power supply unit (40) can be inserted into and withdrawn from said power supply unit compartment (14); and e. said power supply unit (40) being releasably held in the power supply unit compartment (14) in the inserted position by means of at least one magnet (70, 72) and/or by means of at least one spring element (16, 18, 76) which is biased from the outside against a side face of the power supply unit (40); and f. wherein the power supply unit (40) comprises an LED charge state indicator (62).

18. Wheelchair lighting control unit according to claim 17, wherein the power supply unit (40) comprises a socket (52) for electrically connecting the power supply unit (40) to the control electronics (28).

19. Wheelchair lighting control unit (1) comprising:

a. a housing (10);

b. control electronics (28) for driving at least one LED light of a wheelchair, the control electronics being arranged in the housing (10); and c. a power supply unit (40) for supplying power to the wheelchair lighting control unit (1);

d. said housing (10) having a power supply unit compartment (14) for receiving said power supply unit (40), said power supply unit compartment (14) being always open on a side wall of said housing (10) so that said power supply unit (40) can be inserted into and withdrawn from said power supply unit compartment (14); and e. said power supply unit (40) being releasably held in the power supply unit compartment (14) in the inserted position by means of at least one magnet (70, 72) and/or by means of at least one spring element (16, 18, 76) which is biased from the outside against a side face of the power supply unit (40);

f. wherein the power supply unit (40) comprises a USB power bank (42) which is integrated into a power supply unit housing (44, 46).

20. Wheelchair lighting control unit according to claim 19, wherein the terminals of the USB power bank (42) are electrically connected to a magnetically connectable charging terminal (56) and a socket (52) for the electrical connection of the power supply unit (40) to the control electronics (28), in particular are electrically connected via electrical plug connectors.

* * * * *